US010359229B2

(12) United States Patent
Isaacson et al.

(10) Patent No.: US 10,359,229 B2
(45) Date of Patent: Jul. 23, 2019

(54) FLOATING LIQUEFIED NATURAL GAS COMMISSIONING SYSTEM AND METHOD

(71) Applicant: Excelerate Energy Limited Partnership, The Woodlands, TX (US)

(72) Inventors: Daniel Isaacson, The Woodlands, TX (US); Thomas M. Norton, Everglades City, FL (US)

(73) Assignee: Excelerate Energy Limited Partnership, The Woodlands, TX (US)

( * ) Notice: Subject to any disclaimer, the term of this patent is extended or adjusted under 35 U.S.C. 154(b) by 134 days.

(21) Appl. No.: 15/695,916

(22) Filed: Sep. 5, 2017

(65) Prior Publication Data

US 2017/0363350 A1 Dec. 21, 2017

Related U.S. Application Data

(62) Division of application No. 14/634,554, filed on Feb. 27, 2015, now Pat. No. 9,810,478.

(Continued)

(51) Int. Cl.
*F25J 1/00* (2006.01)
*B63B 25/16* (2006.01)

(Continued)

(52) U.S. Cl.
CPC ..... *F25J 1/0022* (2013.01); *B63B 25/16* (2013.01); *F25J 1/0025* (2013.01); *F25J 1/0247* (2013.01);

(Continued)

(58) Field of Classification Search
CPC ..... B63B 2035/448; B63B 2035/4486; B63B 27/24; B63B 22/021; F17C 2223/0161;

(Continued)

(56) References Cited

U.S. PATENT DOCUMENTS 5,025,860 A * 6/1991 Mandrin ..... B63B 35/44 166/267
8,490,563 B1 * 7/2013 Shivers, III ..... B63B 27/24 114/230.14

(Continued)

*Primary Examiner* — Keith M Raymond
(74) *Attorney, Agent, or Firm* — Frederic Dorwart, Lawyers PLLC; Penina Michlin Chiu

(57) ABSTRACT

A floating liquefied natural gas ("FLNG") commissioning system and method are described. A system for commissioning a FLNG vessel comprises a floating liquefaction vessel positioned offshore proximate a shipyard, the floating liquefaction vessel comprising a natural gas liquefaction module and a first LNG storage tank cryogenically coupled to the natural gas liquefaction module, a regasification vessel positioned alongside the floating liquefaction vessel, the regasification vessel comprising a second LNG storage tank fluidly coupled to a regasification facility onboard the regasification vessel, a high pressure natural gas conduit extending between an output of the regasification facility and an input of the liquefaction module, a cryogenic transfer member extending between the second LNG storage tank and the first LNG storage tank, and a gaseous natural gas coupling extending between the natural gas liquefaction module and one of the first LNG storage tank, the second LNG storage tank or a combination thereof.

8 Claims, 4 Drawing Sheets

Related U.S. Application Data

(60) Provisional application No. 61/948,170, filed on Mar. 5, 2014.

(51) Int. Cl.
*B63B 35/44* (2006.01)
*F25J 1/02* (2006.01)

(52) U.S. Cl.
CPC ..... *F25J 1/0272* (2013.01); *F25J 1/0278* (2013.01); *B63B 2035/448* (2013.01); *F17C 2265/05* (2013.01); *F17C 2270/0105* (2013.01); *F25J 2210/62* (2013.01)

(58) Field of Classification Search
CPC ..... F17C 2265/033; F17C 2265/034; F25J 1/0022; F25J 1/0272; F25J 1/0278; F25J 2290/72
See application file for complete search history.

(56) References Cited

U.S. PATENT DOCUMENTS

| | | | | |
|---|---|---|---|---|
| 8,640,493 | B1 * | 2/2014 | Shivers, III | F25J 1/005 114/230.14 |
| 9,919,911 | B2 * | 3/2018 | Hallot | B63B 27/24 |
| 2006/0010911 | A1 * | 1/2006 | Hubbard | F17C 3/04 62/611 |
| 2008/0242165 | A1 * | 10/2008 | Adkins | B63B 22/021 441/4 |
| 2010/0263389 | A1 * | 10/2010 | Bryngelson | F16L 37/002 62/50.2 |
| 2012/0047942 | A1 * | 3/2012 | Kolodziej | B63B 27/24 62/611 |

* cited by examiner

FLOATING LIQUEFIED NATURAL GAS COMMISSIONING SYSTEM AND METHOD

CROSS REFERENCE TO RELATED APPLICATIONS

The present application is a divisional of U.S. application Ser. No. 14/634,554 to Isaacson et al., filed Feb. 27, 2015, and entitled "FLOATING LIQUEFIED NATURAL GAS COMMISSIONING SYSTEM AND METHOD," which claims the benefit of U.S. Provisional Application No. 61/948,170 to Isaacson et al., filed Mar. 5, 2014 and entitled "FLOATING LIQUEFIED NATURAL GAS COMMISSIONING SYSTEM AND METHOD," each of which are hereby incorporated by reference in their entireties.

BACKGROUND OF THE INVENTION

1. Field of the Invention

Embodiments of the invention described herein pertain to the field of floating liquefaction of natural gas. More particularly, but not by way of limitation, one or more embodiments of the invention enable a floating liquefied natural gas commissioning system and method.

2. Description of the Related Art

Natural gas is often transported by seagoing vessel from the location where it is produced to the location where it is consumed. Liquefaction of natural gas facilitates storage and transportation of the natural gas, since liquefied natural gas ("LNG") takes up only about 1/600 of the volume that the same amount of natural gas does in its gaseous state. LNG is produced by cooling natural gas below its boiling point (−259° F. at atmospheric pressure). LNG may be stored in cryogenic containers slightly above atmospheric pressure. By raising the temperature of the LNG, it may be converted back to its gaseous form.

Natural gas produced in locations where it is abundant, may be liquefied and shipped overseas in this manner to locations where it is most needed. Typically, the natural gas is gathered through one or more pipelines to a liquefaction facility. Land-based liquefaction facilities and the associated gathering pipelines are costly, may occupy large areas of land, take several years to permit and construct and may not be practical or economical for offshore stranded natural gas reserves. Thus, demand has stimulated the development of floating natural gas liquefaction ("FLNG").

FLNG facilities capable of producing, storing and offloading LNG, are typically autonomous floating structures including a vessel hull and liquefaction trains on deck. FLNG vessels are constructed in a shipyard, and then towed to a destination site where they may be integrated with the gas source. Prior to being placed in operation, an FLNG vessel must be properly commissioned. Commissioning involves the testing of all the equipment onboard the FLNG vessel, including the liquefaction facilities, in order to ensure proper operation prior to the vessel being put into service.

It has been proposed that commissioning take place at the destination site where a gas source is readily available. However, the destination site may be thousands of miles from the shipyard, and in the instance that any problems arise during commissioning, the FLNG vessel will be far from needed testing equipment and parts that are typically only available in the shipyard. Towing the FLNG vessel back to the shipyard would be time consuming and expensive, potentially setting a liquefaction project irreparably off-schedule or over-budget.

It has also been proposed that commissioning take place at an offshore location close to the shipyard. In this latter instance, the problem arises that there is no readily available gas source near the shipyard for use in testing the liquefaction trains. One suggestion has been to use LNG carriers to transport LNG to the commissioning site. However, the drawback to this solution is that the natural gas onboard conventional LNG carriers is already in liquefied form. Thus, the only gas available for use in testing the FLNG liquefaction trains is natural boil-off gas ("BOG") located in the cargo tanks of the LNG carriers. The use of BOG for commissioning is not ideal because BOG is typically at a pressure of 2-3 bar, whereas during normal operation of the FLNG, the gas to be liquefied would be at about 45-100 bar. Thus, use of BOG for commissioning means accepting commissioning at lower than normal operating pressures, or boosting the pressure of the BOG prior to its use in testing—neither of which is a satisfactory solution due to added costs or risk of improper commissioning conditions.

Therefore, there is a need for a floating liquefied natural gas commissioning system and method.

BRIEF SUMMARY OF THE INVENTION

One or more embodiments of the invention enable a floating liquefied natural gas commissioning system and method.

A floating liquefied natural gas commissioning system and method are described. An illustrative embodiment of a system for commissioning a FLNG vessel comprises a floating liquefaction vessel positioned offshore proximate a shipyard, the floating liquefaction vessel comprising a natural gas liquefaction module on a deck and a first LNG storage tank below the deck cryogenically coupled to an output of the natural gas liquefaction module, a regasification vessel positioned alongside the floating liquefaction vessel, the regasification vessel comprising a second LNG storage tank fluidly coupled to an input of a regasification facility onboard the regasification vessel, a high pressure natural gas conduit extending between an output of the regasification facility and an input of the liquefaction module, a cryogenic transfer member extending between the second LNG storage tank and the first LNG storage tank, and a gaseous natural gas coupling extending between the output of the natural gas liquefaction module and one of the first LNG storage tank, the second LNG storage tank or a combination thereof. In some embodiments, the high pressure natural gas conduit comprises a flexible high pressure hose or a high pressure loading arm located on the regasification vessel. In some embodiments the regasification vessel and liquefaction vessel are moored at a dock. In certain embodiments, the liquefaction vessel and the regasification vessel are underway proximate the shipyard.

An illustrative embodiment of a method for commissioning an FLNG vessel comprises positioning a floating liquefaction vessel at an offshore location proximate a shipyard, positioning a regasification vessel comprising an LNG cargo adjacent the liquefaction vessel, regasifying the LNG cargo onboard the regasification vessel to produce high pressure natural gas, transferring the high pressure natural gas from the regasification vessel to a liquefaction module onboard the liquefaction vessel; liquefying at least a portion of the high pressure natural gas using the liquefaction module onboard the liquefaction vessel to produce reliquefied natural gas, storing the reliquefied natural gas in a storage tank onboard the liquefaction vessel, and returning the reliquefied natural gas from the storage tank onboard the liquefaction vessel to a cargo tank onboard the regasification vessel. In some embodiments, the method further comprises pretreating the high pressure natural gas onboard the liquefaction vessel prior to liquefaction. In certain embodiments, the method further comprises sending any portion of the high pressure natural gas unliquefied by the liquefaction module to the cargo tank onboard the regasification vessel as gaseous natural gas.

An illustrative embodiment of a method of testing the ability of a floating liquefaction vessel to liquefy and store natural gas, comprises positioning a floating liquefaction vessel at an offshore location proximate a shipyard, positioning a regasification vessel comprising an LNG cargo proximate the liquefaction vessel, regasifying the LNG cargo onboard the regasification vessel to produce high pressure natural gas, transferring the high pressure natural gas from the regasification vessel to a liquefaction module onboard the liquefaction vessel, attempting to liquefy the high pressure natural gas onboard the liquefaction vessel to produce reliquefied natural gas, storing any reliquefied natural gas so produced in a storage tank onboard the liquefaction vessel, and returning one of gaseous natural gas, any reliquefied natural gas or both to the regasification vessel, wherein the gaseous natural gas is produced from high pressure natural gas unsuccessfully liquefied. In some embodiments, the one of the gaseous natural gas, the reliquefied natural gas or both returned to the regasification vessel are stored in a cargo tank onboard the regasification vessel. In certain embodiments the method further comprises sending the floating liquefaction vessel to the proximate shipyard for repairs when the attempt to liquefy the high pressure natural gas is unsuccessful.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of illustrative embodiments of the invention will be more apparent from the following more particular description thereof, presented in conjunction with the following drawings wherein.

Figure 1A:
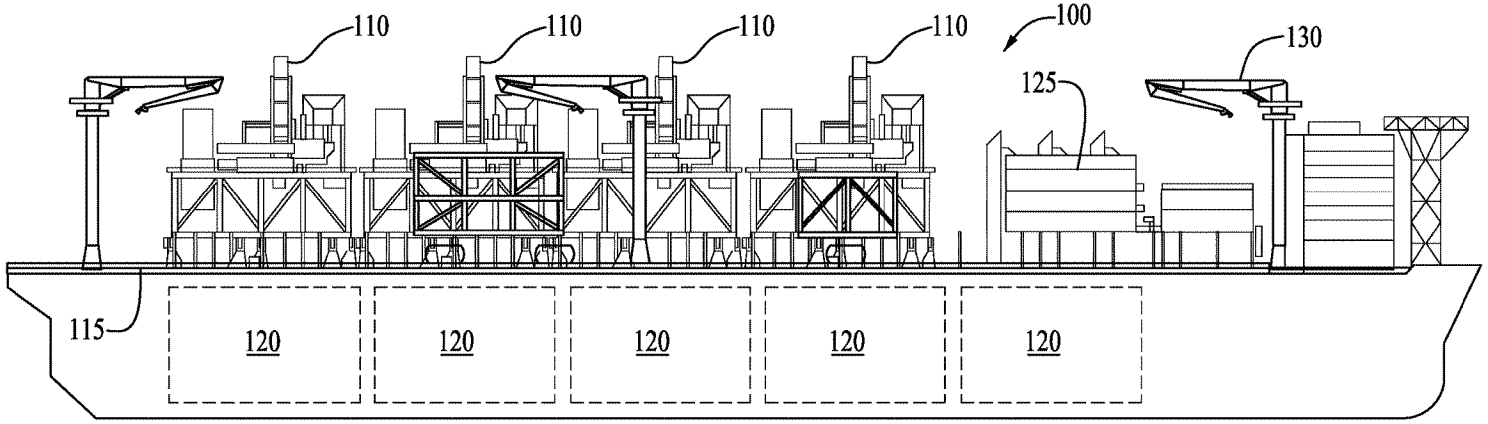
FIG. 1A illustrates a schematic of a profile view of a floating liquefaction vessel of an illustrative embodiment.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

A floating liquefied natural gas commissioning system and method will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a liquefaction module includes one or more liquefaction modules.

"Coupled" refers to either a direct connection or an indirect connection (e.g., at least one intervening connection) between one or more objects or components. The phrase "directly attached" means a direct connection between objects or components.

As used in this specification, "or" is used to mean "and/or" unless explicitly indicated to refer to alternatives only or the alternatives are mutually exclusive.

As used in this specification and the appended claims "high pressure" means, with respect to gaseous natural gas, between a pressure of about 45 bar and about 100 bar. With respect to a conduit, pipe, hose and/or transfer member for transferring gaseous natural gas, "high pressure" means capable of maintaining, transferring and/or accommodating natural gas at a pressure of between about 45 bar and about 100 bar.

One or more embodiments of the invention provide a floating liquefied natural gas commissioning system and method. While for illustration purposes the invention is described in terms of natural gas, nothing herein is intended to limit the invention to that embodiment. The invention may be equally applicable to other hydrocarbon gases which may be transported as cryogenic liquids on a floating vessel, for example petroleum gas, ethane or ethylene.

The invention disclosed herein includes a floating liquefied natural gas commissioning system and method. The systems and methods of illustrative embodiments may provide for more expedient and cost effective commissioning of liquefaction vessels close to the shipyard. In the event commissioning tests are wholly or partially unsuccessful, the liquefaction vessel may be returned to the shipyard for repairs or tests more quickly and cost-effectively than conventional methods. Liquefaction facilities onboard the vessel may be tested at normal, rather than reduced, operating pressures.

A floating liquefaction vessel may be positioned and/or moored offshore proximate a shipyard for purposes of commissioning the liquefaction vessel. For example, the floating liquefaction vessel may be positioned and/or moored offshore 20 miles, 30 miles or 40 miles from a shipyard and/or in waters with convenient access to a desired shipyard. A regasification vessel may moor alongside and/or adjacent the liquefaction vessel. The regasification vessel uses an onboard liquefied natural gas (LNG) regasification facility to vaporize LNG from the cargo tanks onboard the regasification vessel and produce high pressure natural gas. The high pressure natural gas may be transferred from the regasification facility onboard the regasification vessel to the liquefaction module onboard the liquefaction vessel.

In some embodiments, the high pressure gas is transferred using a high pressure gas arm or high pressure flexible hose operatively coupled between the output of the regasification facility onboard the regasification vessel and the input of the liquefaction module onboard the liquefaction vessel. The liquefaction module, piping, equipment and storage tanks onboard the liquefaction vessel may then be tested by attempting to liquefy and/or liquefying the high pressure natural gas provided by the regasification vessel. Natural gas liquefied by the liquefaction module may be stored on storage tanks onboard the liquefaction vessel. From the liquefaction vessel storage tanks, the reliquefied natural gas may be returned to the storage tanks onboard the regasification vessel. In some embodiments, the LNG is returned to the regasification vessel using cryogenic LNG and vapor (e.g., boil-off gas) conduits, which may be arms or hoses. Returned LNG may be transferred from the storage tanks onboard the liquefaction vessel to the cargo tanks onboard the regasification vessel. In the instance commissioning is unsuccessful, the liquefaction vessel may be easily transported back to the proximate shipyard for repairs or further testing.

Figure 1B:
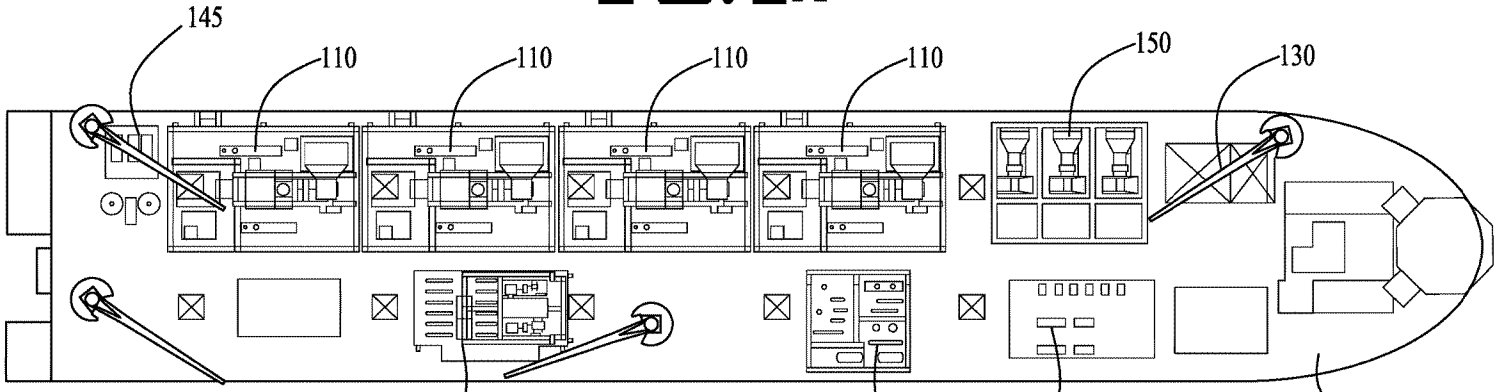
FIG. 1B illustrates a schematic of a plan view of a deck of a floating liquefaction vessel of an illustrative embodiment.
Figure 1C:
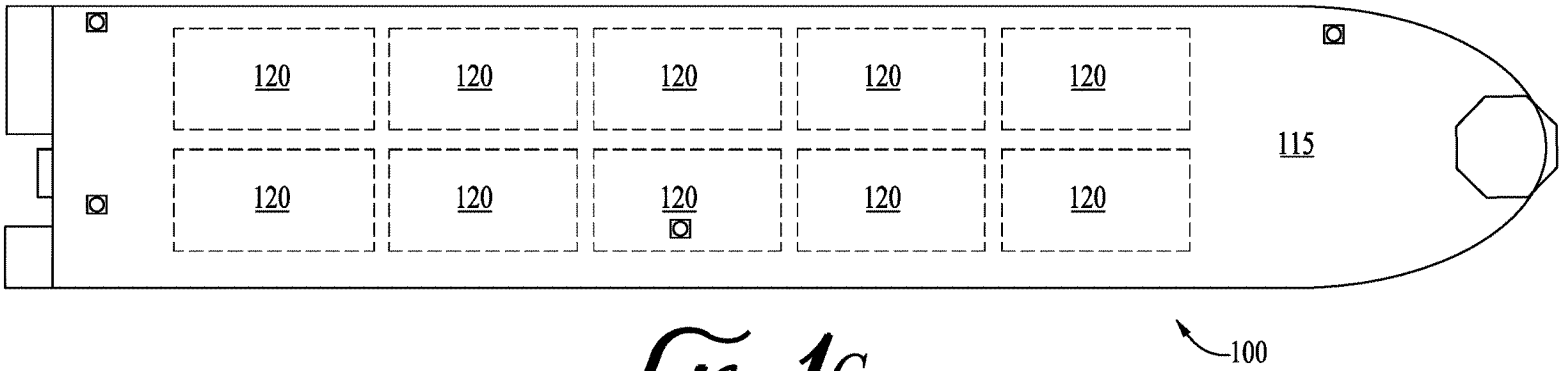
FIG. 1C illustrates a schematic of a plan view of a hull and LNG storage tank arrangement of a floating liquefaction vessel of an illustrative embodiment.

FIGS. 1A-1C illustrate one embodiment of an exemplary floating liquefaction vessel for use in the system of an illustrative embodiment. In some embodiments, liquefaction vessel 100 may be a floating liquefaction storage and offloading unit or an FLNG. In some embodiments, floating liquefaction unit 100 may or may not be capable of its own propulsion. Floating liquefaction unit 100 may include a liquefaction train including liquefaction module 110. An example of liquefaction module 110 includes, but is not limited to, liquefaction systems provided by Black & Veatch Corporation of Overland Park, Kans., United States, Air Products and Chemicals, Inc. of Allentown, Pa. or CB&I Lummus of The Hague, Netherlands. Liquefaction module 110 may accommodate a broad range of gas-quality specifications. Liquefaction module 110 may be located on deck 115 or other location onboard floating liquefaction unit 100. Floating liquefaction unit 100 may include one, two, three, four or more liquefaction modules 110. As shown in FIGS. 1A and 1B floating liquefaction unit 100 may include four liquefaction modules 110, each having about one million tons per annum (MTPA) processing capacity, but a floating liquefaction vessel 100 of any capacity may be commissioned using the system and method of illustrative embodiments described herein.

Floating liquefaction unit 100 may also include cryogenic LNG storage tanks 120. LNG storage tanks 120 may be membrane, self-supporting prismatic or self-supporting spherical type cargo tanks. As shown in FIG. 1C, ten membrane LNG storage tanks 120 may be utilized in a side-by-side configuration to minimize sloshing and provide mid-span deck support for installed liquefaction train(s). In some embodiments, floating liquefaction unit 100 may be capable of storing about 250,000 $m^3$ of LNG.

Floating liquefaction unit 100 may also include boil-off gas (BOG) system 140 to handle natural boil-off of the LNG from LNG storage tanks 120. In some embodiments, BOG may be used as fuel for liquefaction modules 110, power generation system 150 and/or a propulsion system (not shown) onboard floating liquefaction unit 100. Floating liquefaction unit 100 may also include fractionation system 135 for the removal of heavier hydrocarbons, refrigerant make-up system 145, inert gas/dry air system to provide inert gas and/or dry air to LNG storage tank 120 as part of gas freeing operations for inspection and/or maintenance, a nitrogen system to purge LNG piping, control room 125, LNG unloading arms such as cryogenic transfer members 305 (shown in FIG. 3), high pressure gas loading arms such as high pressure gas conduit 300 (shown in FIG. 3), accommodations for the facility workers, fixed crane 130 and/or other such equipment as is well known to those of skill in the art.

Figure 2:
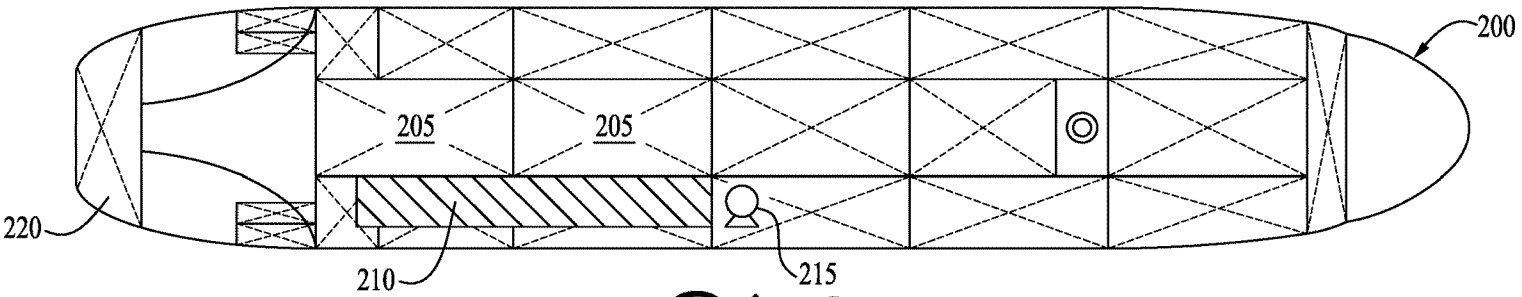
FIG. 2 illustrates a schematic of a top view of an illustrative embodiment of a regasification vessel.

FIG. 2 illustrates a regasification vessel for use in the system and method of illustrative embodiments. Regasification vessel 200 may be an ocean going vessel that may be used for the transportation of LNG from one location to another, which is well known to those of skill in the art. Regasification vessel 200 may be any floating method of conveyance for LNG, such as a carrier or barge. Regasification vessel 200 may be double hulled and include at least one insulated cryogenic cargo tank 205, which may store LNG at about −162° C. Pressure in cargo tank 205 may be kept constant by allowing boil off gas to escape from the storage tank. Gaztransport & Technigaz SA of Saint-Remy-les-Chevreuse, France supplies specially reinforced No. 96 type membrane tanks which are suitable. SPB prismatic tanks supplied by IHI Corporation of Tokyo, Japan, Moss Spherical tanks supplied by Moss Maritime AS of Lysaker, Norway and GTT MKIII tanks supplied by Gaztransport & Technigaz SA of Saint-Remy-les-Chevreuse, France are also suitable cargo tanks. These cargo tanks may also be used as LNG storage tank 120 onboard liquefaction vessel 100.

LNG may be vaporized on regasification vessel 200 at regasification facility 210 using methods known in the art for onboard vaporization of LNG. Examples of suitable systems for regasification of LNG are described in U.S. Pat. No. 7,484,371 to Nierenberg; U.S. Pat. No. 7,293,600 to Nierenberg; U.S. Pat. No. 7,219,502 to Nierenberg; U.S. Pat. No. 6,688,114 to Nierenberg; and U.S. Pat. No. 6,598,408 to Nierenberg. In an embodiment, heat from at least one heat source—such as surrounding seawater or steam from a boiler onboard regasification vessel 200—may be transferred to the LNG through heat exchangers (e.g., shell and tube heat exchangers and/or printed circuit heat exchangers), which allows for regasification of the LNG. In certain embodiments, regasification vessel 200 includes high pressure cryogenic pump 215 to bring the LNG from at least one cargo tank 205 up to high pressure prior to vaporization, regasification facilities 210 to convert the LNG to gaseous natural gas, oversized boilers to provide power and sustain the vessel operations along with the shipboard regasification process, and reinforced LNG cargo tanks 205 and internal pump towers designed to withstand sloshing loads encountered through all loading levels.

Figure 3:
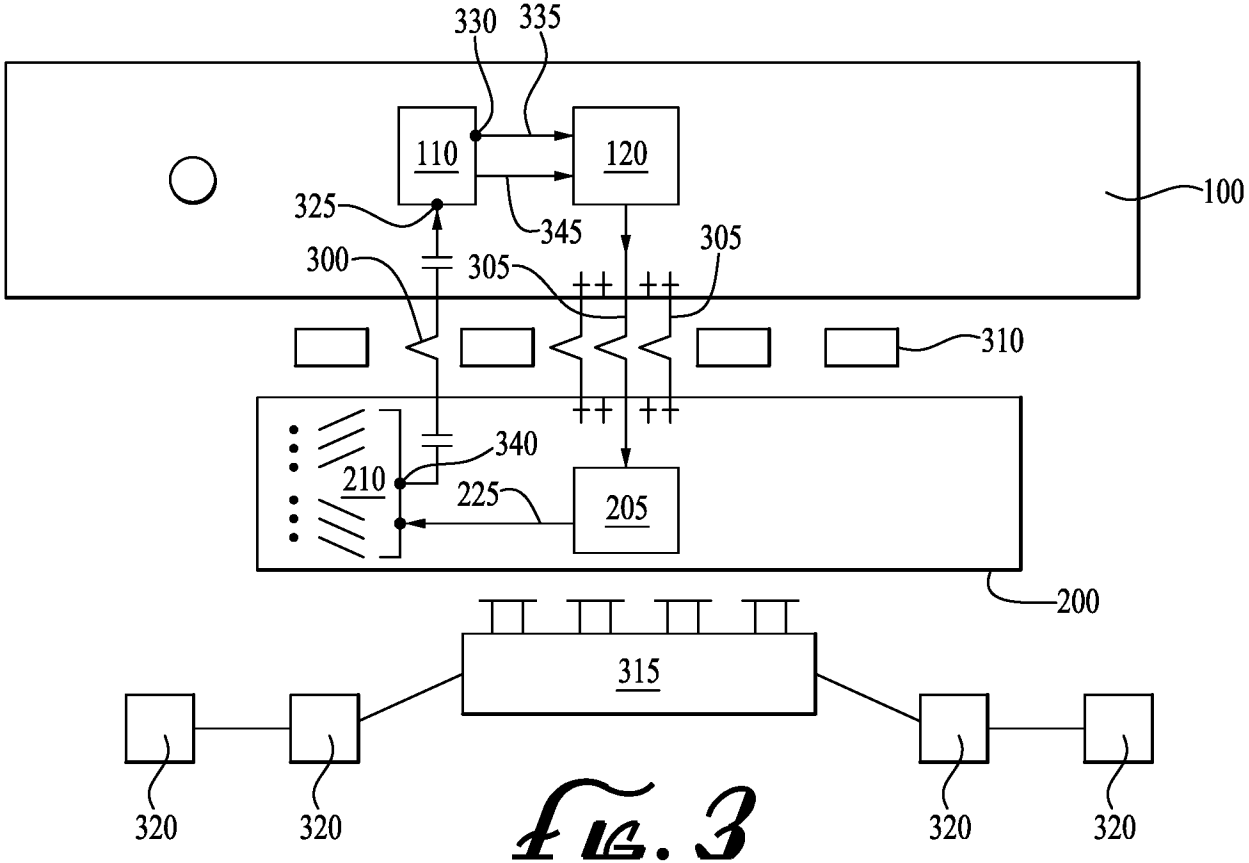
FIG. 3 illustrates a schematic of an illustrative embodiment of a system for commissioning a floating liquefaction vessel.

FIG. 3 illustrates a schematic of an illustrative embodiment of a system for commissioning a liquefaction vessel. Liquefaction vessel 100 may be positioned and/or moored offshore proximate a shipyard, for example 20, 30 or 40 miles from the shipyard. Optionally, liquefaction vessel 100 may be moored at or anchored near marine berth 315, which may be a jetty, the shore or a sea island. Regasification vessel 200 may be positioned and/or moored alongside (side by side) liquefaction vessel 100 or the vessels may instead be moored in a tandem configuration. In some embodiments, regasification vessel 200 and/or liquefaction vessel 100 may be moored at marine berth 315. Marine berth 315 may include mooring dolphins 320 for connection of mooring lines. For example, twelve to sixteen mooring lines may be run from regasification vessel 200 and/or liquefaction vessel 100 to mooring dolphins 320 to keep one or more of the vessels alongside the berth. Fenders 310 may assist in protecting the vessels from collisions with each other and/or marine berth 315.

In alternative embodiments, regasification vessel 200 and/or liquefaction vessel 100 may be at anchor in open water, rather than at marine berth 315. In embodiments where liquefaction vessel 100 has propulsion, regasification vessel 200 and liquefaction vessel 100 may be underway during commissioning methods of illustrative embodiments.

High pressure gas conduit 300 may be employed to transfer high pressure natural gas from regasification vessel 200 to liquefaction vessel 100. LNG from cargo tank 205 may be vaporized at regasification facility 210 for purposes of preparing high pressure natural gas for commissioning. LNG may first be transferred from cargo tank 205 onboard regasification vessel 200 through transfer line 225 to regasification facility 210 onboard regasification vessel 200. In an embodiment, the regasification facility output 340 may be fluidly coupled to liquefaction train input 325 using high pressure gas conduit 300. High pressure gas conduit 300 may be a high pressure loading arm. The Emco Wheaton Division of the Engineered Products Group of Gardner Denver, Inc. of Quincy Ill. supplies a suitable high pressure arm designed to handle the high pressure natural gas that may be discharged from regasification vessel 200. In high pressure loading arm embodiments, the high pressure loading arm may be located on regasification vessel 200 or liquefaction vessel 100. In some embodiments, high pressure gas conduit 300 may be a flexible high pressure hose. High pressure gas conduit 300 may deliver natural gas to liquefaction train input 325. In some embodiments, high pressure gas conduit 300 delivers natural gas to fractionation system 135 (shown in FIG. 1B) onboard liquefaction vessel 100 or to gas pretreatment and/or processing facilities onboard floating liquefaction unit 100, rather than directly to the liquefaction train input 325.

Liquefaction module 110 onboard liquefaction vessel 100 may then be tested for proper liquefaction functionality. If LNG is successfully produced by liquefaction module 110, the LNG may be stored in cryogenic storage tank 120 onboard liquefaction vessel 100. The LNG may be transferred from the liquefaction train output 330 to storage tank 120 using cryogenic piping 335 and/or pumps onboard liquefaction vessel 100. Storage tank 120 onboard liquefaction vessel 100 may be the same or a similar type of cryogenic cargo tank as described herein for cargo tank 205 onboard regasification vessel 200. LNG may be transferred from storage tank 120 to regasification vessel 200 via flexible or rigid cryogenic transfer members 305. In some embodiments, LNG may be transferred to regasification vessel 200 directly from the liquefaction train output 330. Cryogenic transfer members 305 may comprise flexible cryogenic hoses, hose saddles, emergency quick release couplings and/or emergency shut down and emergency release systems. In some embodiments cryogenic transfer members 305 may comprise a cryogenic hard arm located on liquefaction vessel 100. Cryogenic transfer members 305 may also include a hose or arm for boil off gas management during transfer operations. Cryogenic transfer members 305 may be designed to handle both gaseous natural gas and liquefied natural gas.

Figure 4:
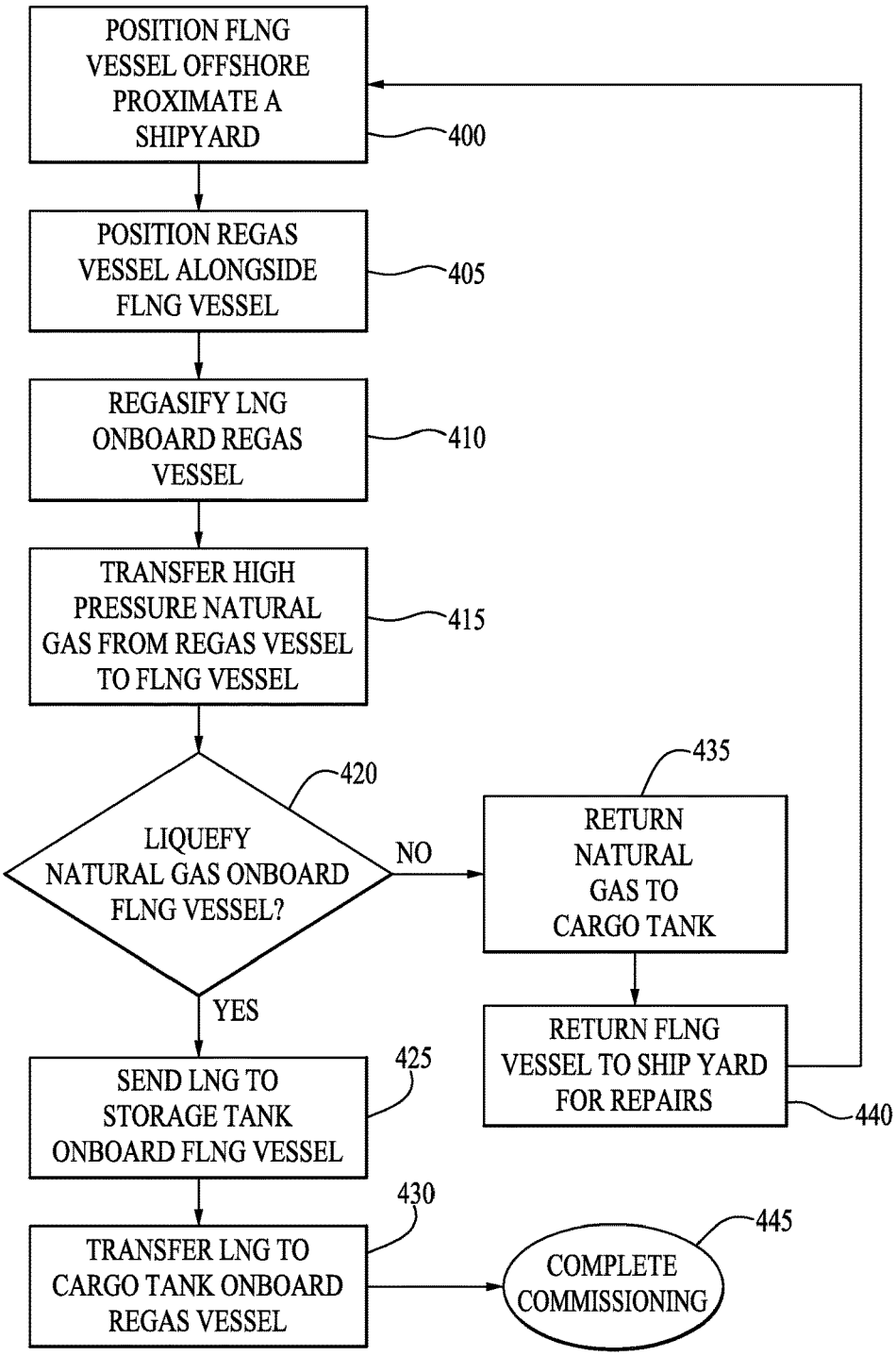
FIG. 4 is a flow chart illustrating an exemplary method of commissioning a floating liquefaction vessel of an illustrative embodiment.

FIG. 4 is a flow chart illustrating an exemplary method for commissioning a floating liquefaction vessel. At step 400, floating liquefaction vessel 100 may be positioned offshore near a shipyard, such as the shipyard in which liquefaction vessel 100 was wholly or partially constructed. Commissioning liquefaction vessel 100 proximate the shipyard reduces or eliminates the need for liquefaction vessel 100 to be towed long distances from the shipyard, for example hundreds or thousands of miles to the location where liquefaction vessel is intended to be implemented. Regasification vessel 200 may be positioned adjacent floating liquefaction vessel 100 at step 405. If the vessel(s) are to be moored, mooring may be accomplished using mooring and fendering techniques well known to those of skill in the art. In some embodiments, regasification vessel 200 may be moored at marine berth 315, at anchor or the vessels may be underway during commissioning. LNG from cargo tanks 205 onboard regasification vessel 200 may be transferred from cargo tank 205 along transfer line 225 to regasification facility 210, and the LNG regasified at step 410 to produce high pressure natural gas. At step 415, the high pressure natural gas may be transferred from regasification vessel 200 to liquefaction vessel 100. In some embodiments, high pressure natural gas may be transferred from the regasification facility output 340 directly to the liquefaction train input 325. In some embodiment, high pressure natural gas may undergo processing or pretreatment onboard liquefaction vessel 100 prior to being transferred to liquefaction module 110 and/or pretreatment facilities onboard liquefaction vessel 100 may be tested using the high pressure natural gas. Conduit 300 may provide for the transfer of the high pressure natural gas to liquefaction vessel 100.

Once onboard floating liquefaction vessel 100, liquefaction module 110 onboard liquefaction vessel 100 may be tested by attempting to liquefy high pressure natural gas at step 420. If the high pressure natural gas is successfully liquefied, in whole or in part, then the high pressure gas successfully liquefied to LNG may be sent using cryogenic piping 335 to LNG storage tank 120 onboard liquefaction vessel 100, at step 425. From storage tank 120, the LNG may be transferred to cargo tank 205 onboard regasification vessel 200 at step 430. Cryogenic transfer members 305 may be used to facilitate the transfer of LNG back to regasification vessel 200.

If on the other hand, the high pressure natural gas is not successfully liquefied, in whole or in part, then any remaining gaseous natural gas may be returned to a cargo tank, such as cargo tank 205 or storage tank 120, at step 435. In one example, remaining gaseous natural gas may be returned to storage tank 120 using gas line 345. In another example, gaseous natural gas may be returned to cargo tank 205 first through cryogenic piping 335 to storage tank 120, and then from storage tank 120 through cryogenic transfer members 305 to cargo tank 205. In some embodiments, the output of liquefaction module 110 may travel through the same cryogenic piping, such as cryogenic piping 335, regardless of whether it is successfully liquefied or not. In other embodiments, a system of controls and/or valves may detect whether the output of liquefaction module 110 has been successfully liquefied and direct the output to the corresponding piping and/or storage tank. In certain embodiments a system of controls and/or valves may be manually operated. Unsuccessfully liquefied gaseous natural gas may no longer be at high pressures, and may instead be at BOG pressures and/or around 2-3 bar. In some embodiments, rather than being stored, unsuccessfully liquefied gaseous natural gas may be dissipated or lost.

In circumstances of unsuccessful commissioning, floating vessel 100 may be returned to the shipyard for repairs and/or further testing at step 440. Returning liquefaction vessel 100 to the shipyard for such purposes may be relatively simple and expedient given the close proximity (e.g., 20-40 miles) of the commissioning location to the shipyard. Once any repairs are completed, the commissioning process may be repeated. Commissioning may be completed at step 445.

The systems and methods of the invention may allow commissioning of a liquefaction vessel in close proximity to a shipyard. Proximity to a shipyard allows the liquefaction vessel to be returned to the shipyard for repairs or testing without excessive towing fees or long travel time. Use of a regasification vessel to provide high pressure natural gas to the liquefaction vessel allows commissioning to take place at normal operating pressures rather than at BOG pressures.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A system for commissioning a FLNG vessel comprising:

a floating liquefaction vessel positioned offshore proximate a shipyard, the floating liquefaction vessel comprising a natural gas liquefaction module on a deck and a first LNG storage tank below the deck cryogenically coupled to an output of the natural gas liquefaction module;

a regasification vessel positioned alongside the floating liquefaction vessel, the regasification vessel comprising a second LNG storage tank fluidly coupled to an input of a regasification facility onboard the regasification vessel;

a high pressure natural gas conduit extending between an output of the regasification facility and an input of the liquefaction module;

a cryogenic transfer member extending between the second LNG storage tank and the first LNG storage tank; and a gaseous natural gas coupling extending between the output of the natural gas liquefaction module and one of the first LNG storage tank, the second LNG storage tank or a combination thereof.

2. The system of claim 1, wherein the high pressure natural gas conduit comprises a flexible high pressure hose.

3. The system of claim 1, wherein the high pressure natural gas conduit comprises a high pressure loading arm located on the regasification vessel.

4. The system of claim 1, wherein the cryogenic transfer member comprises a cryogenic loading arm located on the liquefaction vessel.

5. The system of claim 1, wherein the cryogenic transfer member comprises a cryogenic hose.

6. The system of claim 1, wherein the regasification vessel is moored at a dock.

7. The system of claim 6, wherein the liquefaction vessel is moored at the dock.

8. The system of claim 1, wherein the liquefaction vessel and the regasification vessel are underway proximate the shipyard.

* * * * *